US010816247B2

(12) United States Patent
McQuade

(10) Patent No.: US 10,816,247 B2
(45) Date of Patent: Oct. 27, 2020

(54) HEATING, VENTILATION, AND AIR CONDITIONING CONTROL SYSTEM

(71) Applicant: Johnson Controls Technology Company, Auburn Hills, MI (US)

(72) Inventor: William F. McQuade, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 168 days.

(21) Appl. No.: 15/880,197

(22) Filed: Jan. 25, 2018

(65) Prior Publication Data

US 2019/0170414 A1 Jun. 6, 2019

Related U.S. Application Data

(60) Provisional application No. 62/593,297, filed on Dec. 1, 2017.

(51) Int. Cl.

| | |
|---|---|
| ***F25B 49/00*** | (2006.01) |
| ***F24F 11/36*** | (2018.01) |
| ***F24H 9/20*** | (2006.01) |

(52) U.S. Cl.

CPC ..... *F25B 49/005* (2013.01); *F24F 11/36* (2018.01); *F24H 9/2035* (2013.01); *F25B 2500/222* (2013.01)

(58) Field of Classification Search

CPC .... F24F 11/36; F25B 2500/222; F25B 49/005
See application file for complete search history.

(56) References Cited

U.S. PATENT DOCUMENTS

| | | | | |
|---|---|---|---|---|
| 5,905,438 | A * | 5/1999 | Weiss | G08B 29/181 340/539.1 |
| 6,536,225 | B1 * | 3/2003 | Yajima | F24F 1/02 62/407 |
| 9,600,998 | B2 | 3/2017 | Mumey | |
| 2005/0103029 | A1 * | 5/2005 | Kawahara | F25D 29/008 62/126 |
| 2006/0044133 | A1 * | 3/2006 | Lou | F24C 7/08 340/531 |
| 2006/0191323 | A1 | 8/2006 | Garabedian et al. | |
| 2009/0312883 | A1 | 12/2009 | Myllymaki | |
| 2011/0170377 | A1 | 7/2011 | Legaspi | |
| 2013/0099011 | A1 * | 4/2013 | Matsuoka | G05D 23/1904 236/1 C |
| 2013/0233006 | A1 | 9/2013 | Morimoto et al. | |
| 2015/0362204 | A1 * | 12/2015 | Goel | F24F 11/83 62/180 |
| 2016/0215996 | A1 * | 7/2016 | Blair | G08B 21/187 |
| 2017/0138645 | A1 * | 5/2017 | Sakima | F25B 1/00 |

(Continued)

FOREIGN PATENT DOCUMENTS

| | | | |
|---|---|---|---|
| EP | 268107 | * | 5/1988 |
| EP | 1260886 | A2 | 11/2002 |

*Primary Examiner* — Henry T Crenshaw

(74) *Attorney, Agent, or Firm* — Fletcher Yoder, P.C.

(57) ABSTRACT

A heating ventilation and air conditioning (HVAC) control system. The HVAC control system includes a sensor that detects a refrigerant released from an HVAC system and emits a signal indicative of the detection. The HVAC control system also includes a switch that blocks a flow of electricity to an enclosed space and a controller that receives the signal from the sensor and activates the switch to block the flow of electricity in response to detection of the refrigerant.

21 Claims, 7 Drawing Sheets

(56) References Cited

U.S. PATENT DOCUMENTS

| | | | | |
|---|---|---|---|---|
| 2017/0159961 | A1* | 6/2017 | Kah, III | B01D 46/0086 |
| 2017/0198936 | A1* | 7/2017 | Yamaguchi | F24F 11/74 |
| 2017/0207049 | A1* | 7/2017 | Yang | H02H 3/12 |
| 2018/0106492 | A1* | 4/2018 | Papas | F24F 11/37 |
| 2018/0321121 | A1* | 11/2018 | Rydkin | F25B 49/005 |
| 2018/0327179 | A1* | 11/2018 | Papas | B60P 3/20 |
| 2018/0372344 | A1* | 12/2018 | Abukawa | F24F 1/22 |
| 2019/0154499 | A1* | 5/2019 | Buckley | G01K 1/14 |
| 2019/0212042 | A1* | 7/2019 | Yamada | F25B 41/062 |

* cited by examiner

HEATING, VENTILATION, AND AIR CONDITIONING CONTROL SYSTEM

CROSS REFERENCE TO RELATED APPLICATIONS

This application claims priority from and the benefit of U.S. Provisional Application Ser. No. 62/593,297, entitled "HEATING, VENTILATION, AND AIR CONDITIONING CONTROL SYSTEM," filed Dec. 1, 2017, which is hereby incorporated by reference in its entirety for all purposes.

BACKGROUND

The disclosure relates generally to HVAC systems.

Heating, ventilation, and air conditioning (HVAC) systems cool enclosed spaces by exchanging energy between a refrigerant and air. HVAC systems do this by circulating a refrigerant between two heat exchangers commonly referred to as an evaporator coil and a condenser coil. As refrigerant passes through the evaporator coil and the condenser coil, the refrigerant either absorbs or discharges thermal energy. More specifically, as air passes over the evaporator coil, the air cools as it loses energy to the refrigerant passing through the evaporator coil. In contrast, the condenser enables the refrigerant to discharge heat into the atmosphere. Inasmuch as refrigerant leaks compromise system performance or result in increased costs, it is accordingly desirable to provide detection and response systems and methods for the HVAC system to reliably detect and respond to any refrigerant leaks of the HVAC system.

SUMMARY

The present disclosure relates to a heating ventilation and air conditioning (HVAC) control system. The HVAC control system includes a sensor that detects a refrigerant released from an HVAC system and emits a signal indicative of the detection. The HVAC control system also includes a switch that blocks a flow of electricity to an enclosed space and a controller that receives the signal from the sensor and activates the switch to block the flow of electricity in response to detection of the refrigerant.

The present disclosure also relates to a heating ventilation and air conditioning (HVAC) control system. The HVAC control system includes a sensor that detects a refrigerant released from an HVAC system and emits a signal indicative of the detection. The HVAC control system also includes a valve that blocks a flow of a fluid to an enclosed space and a controller that receives the signal from the sensor and activates the valve to block the flow of the fluid in response to detection of the refrigerant.

The present disclosure also relates to a heating ventilation and air conditioning (HVAC) control system that includes a sensor that detects a refrigerant released from an HVAC system and emits a signal indicative of the detection. The HVAC control system also includes an electronic device and a controller that receives the signal from the sensor and transmits a warning message to the electronic device.

DRAWINGS

DETAILED DESCRIPTION

Embodiments of the present disclosure include an HVAC control system that reduces and/or blocks combustion of a refrigerant. The HVAC control system may include one or more sensors that detect the presence of a refrigerant and communicate this information to a controller. The controller may then compare the signal indicative of a concentration level of a refrigerant to a threshold level. If the concentration level of the refrigerant is above a threshold level, the controller may activate one or more switches to turn off the flow of electricity and/or gas, such as natural gas, to an enclosed space. By blocking the flow of electricity and gas to and/or through the enclosed space, the HVAC control system may block combustion of the refrigerant in the enclosed space. Examples of the enclosed space may be a home, apartment, office building.

Figure 1:
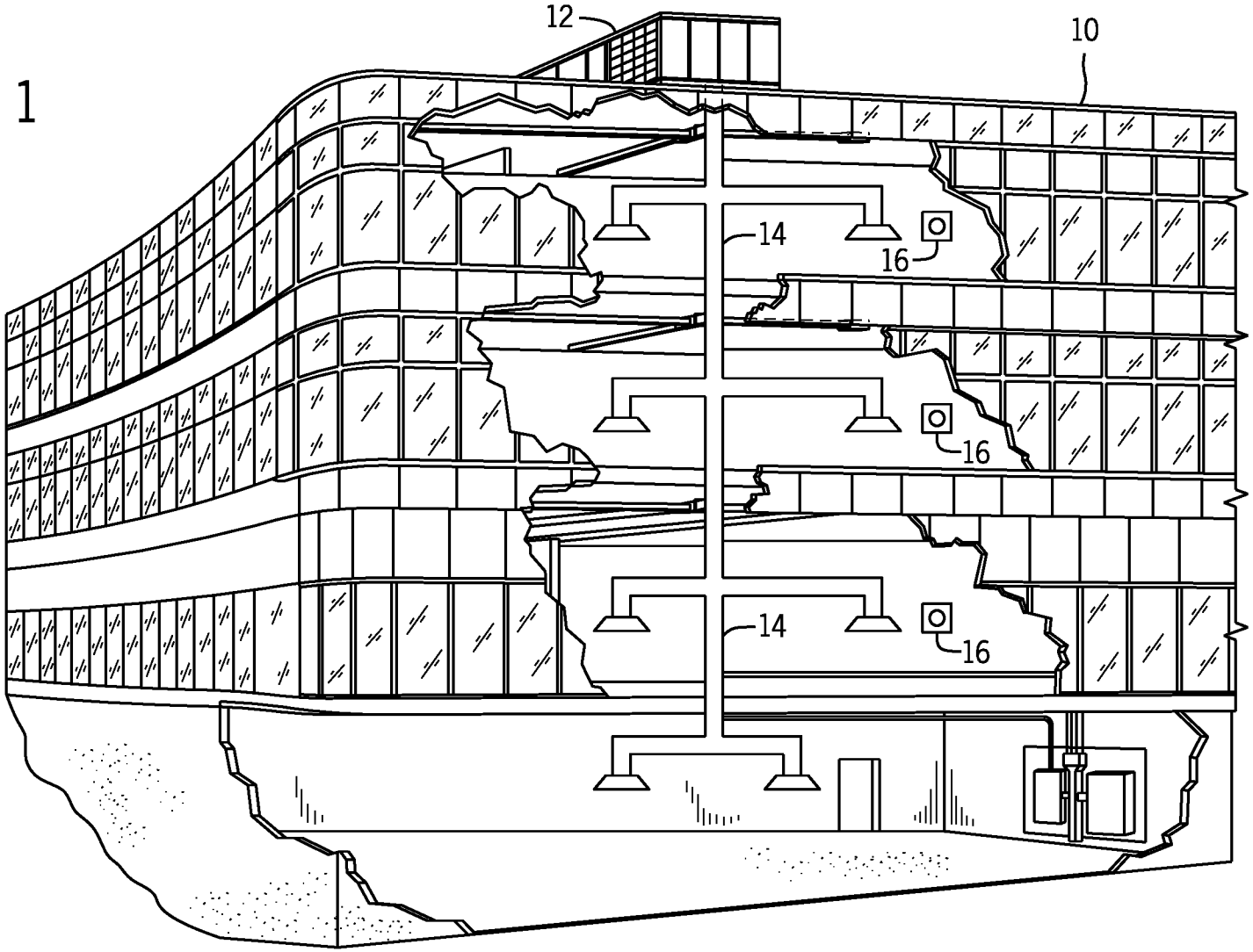
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
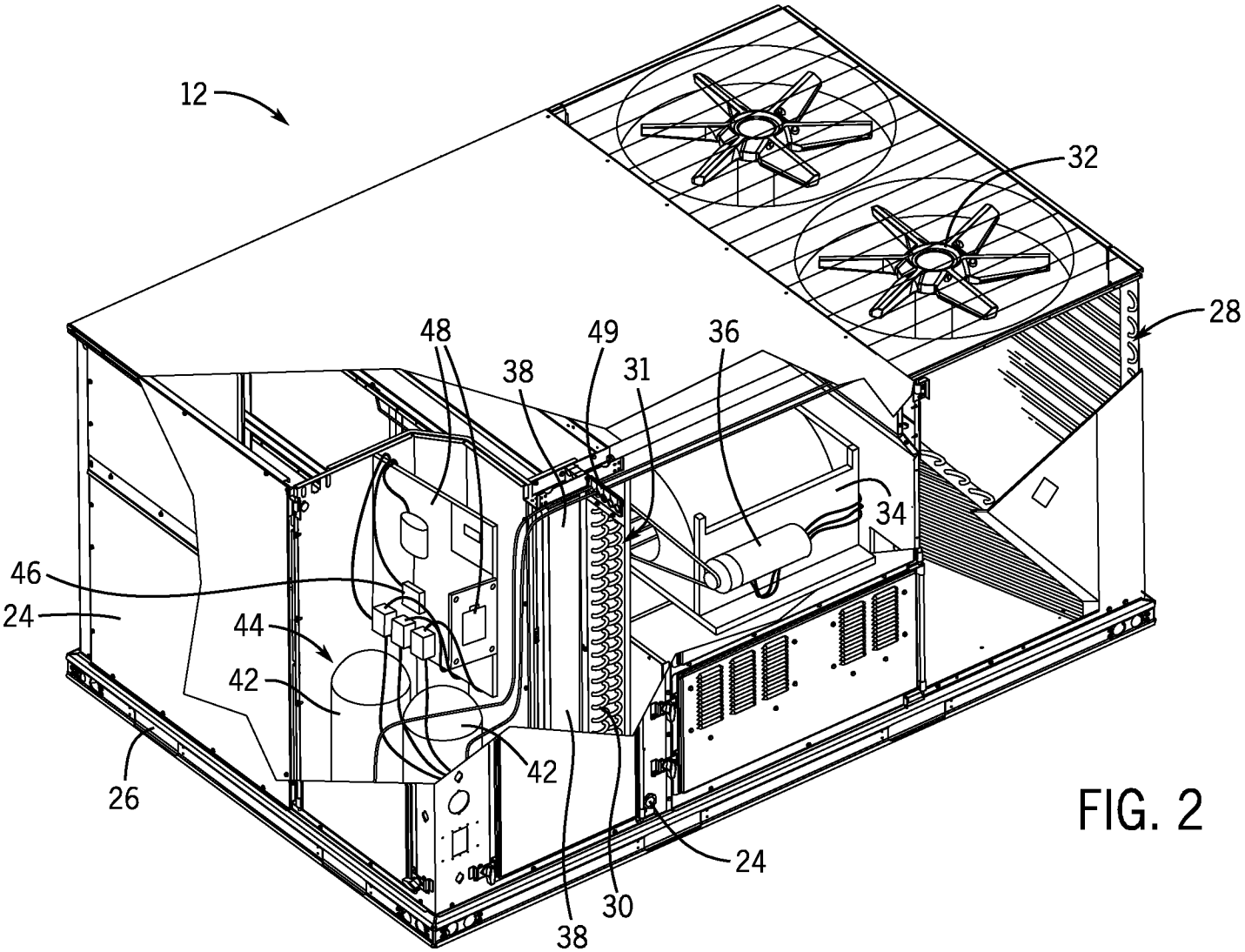
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor control switches. Wiring 49 may connect the control board 48 and the terminal block 46 to the equipment of the HVAC unit 12.

Figure 3:
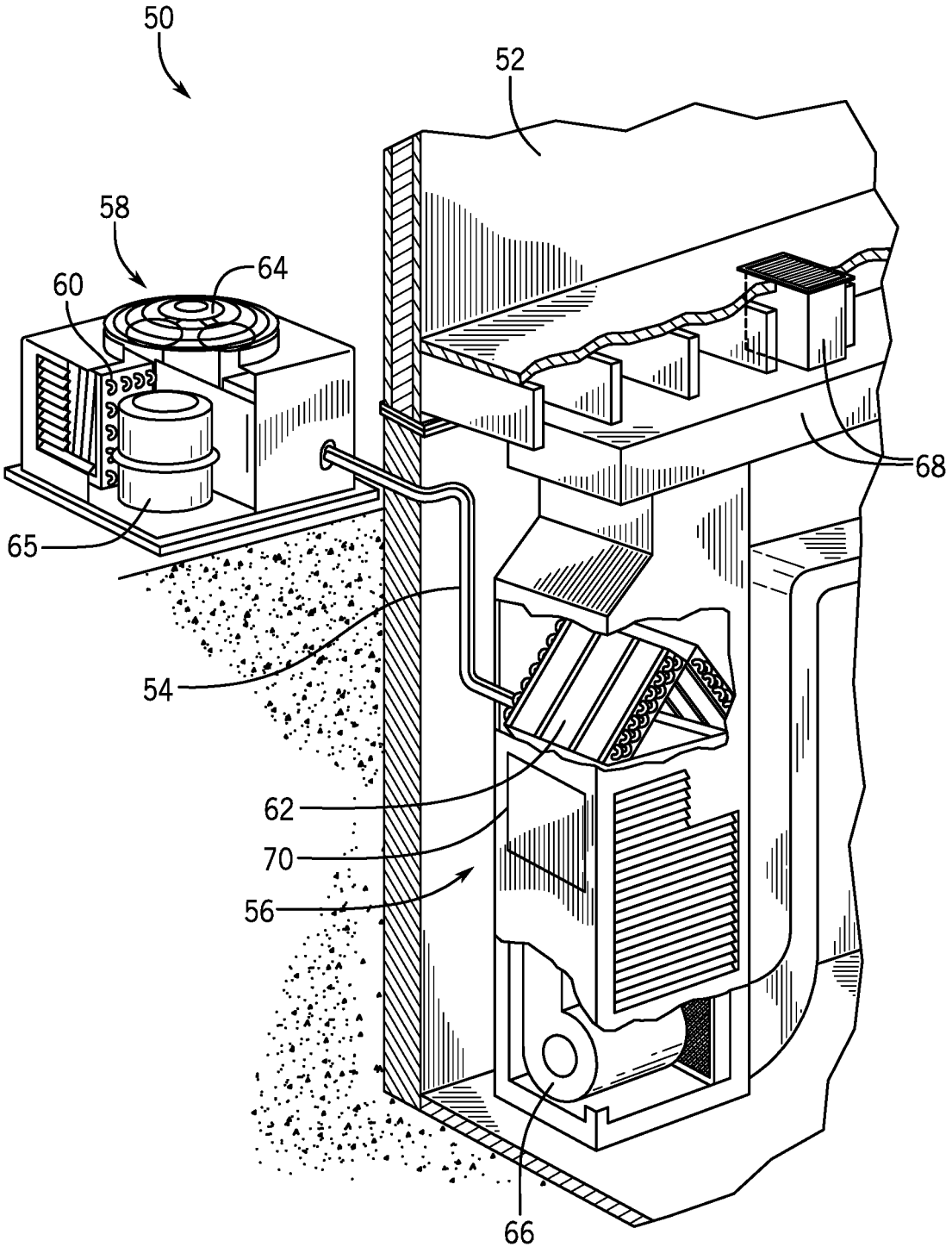
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
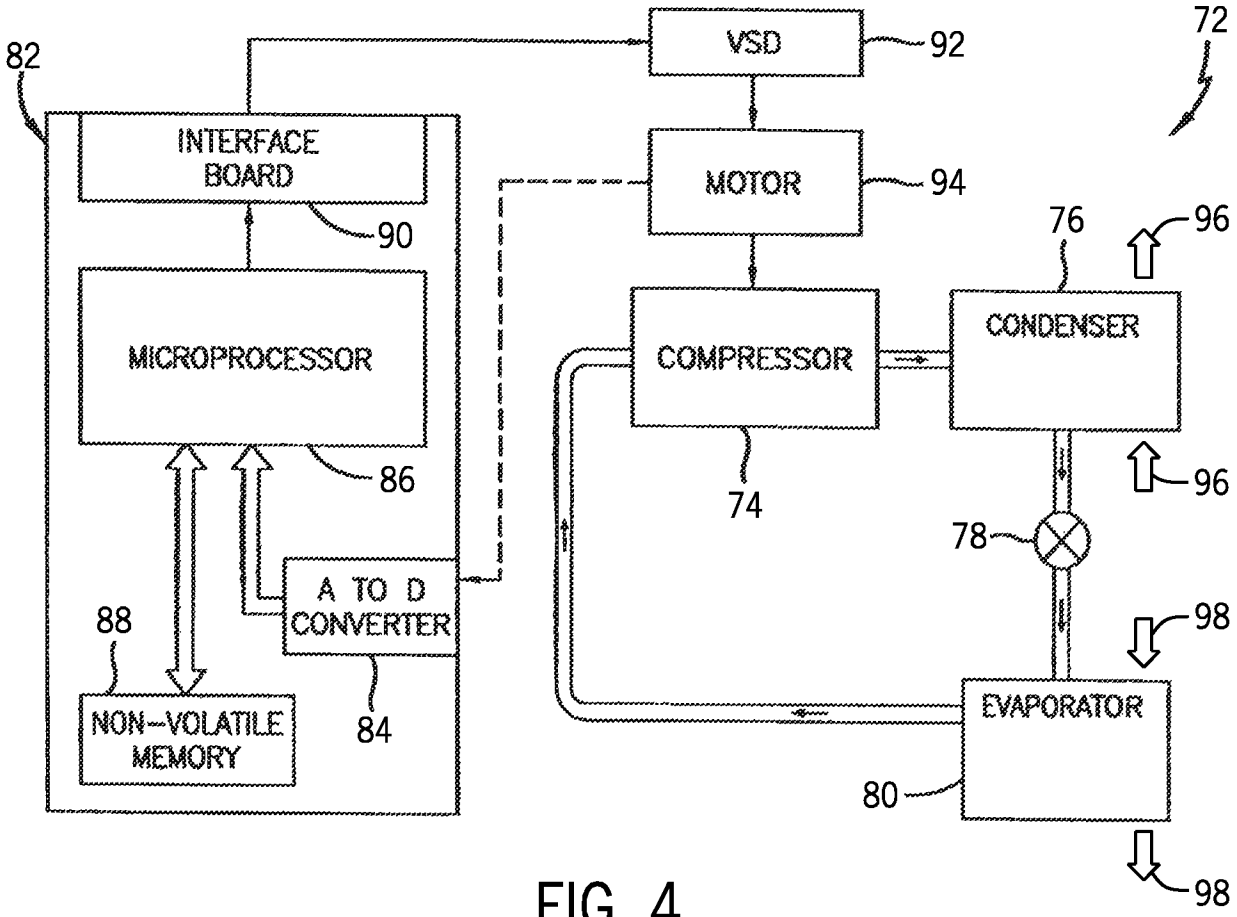
FIG. 4 is a schematic of an embodiment of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a nonvolatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
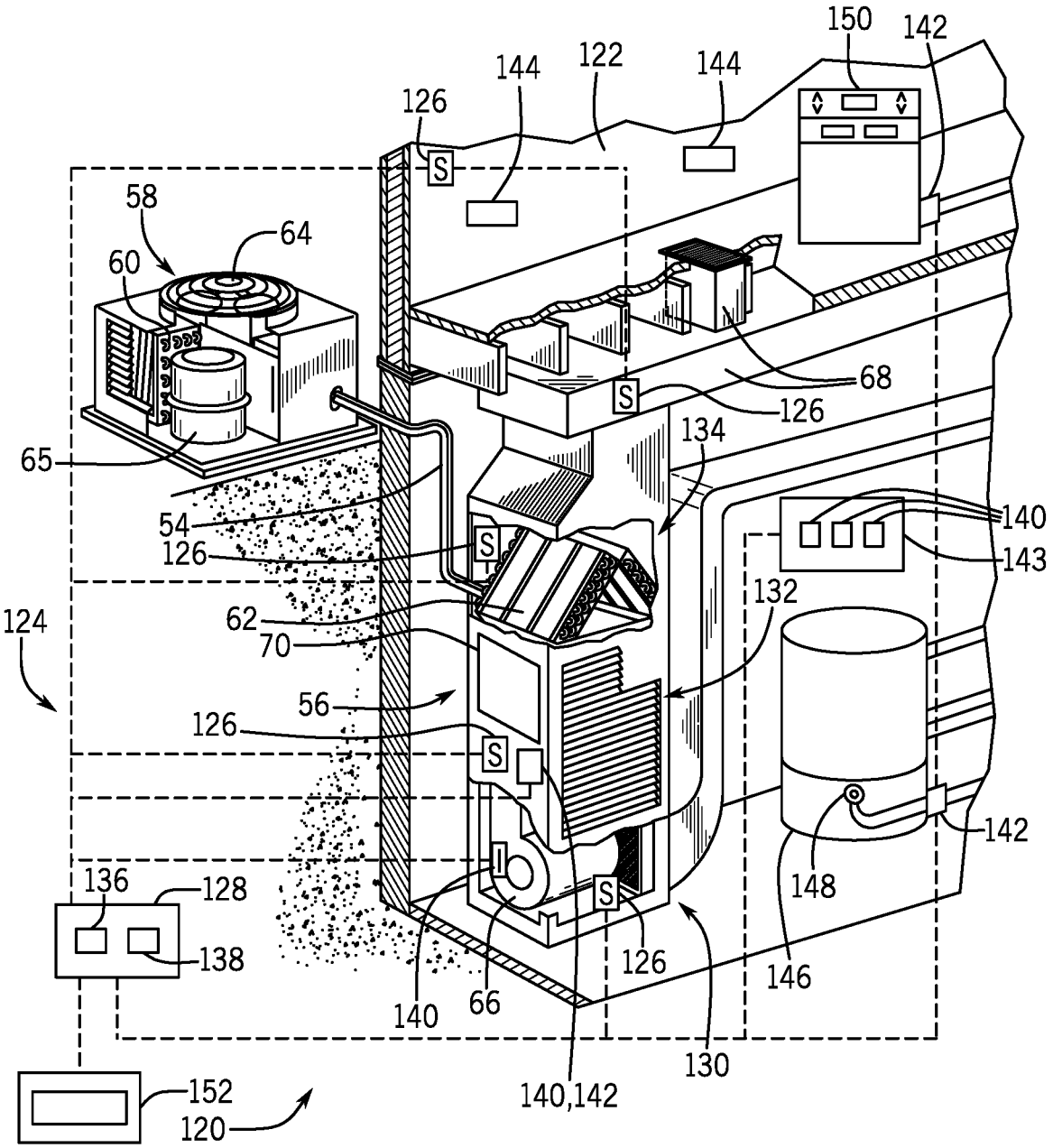
FIG. 5 is a schematic view of an embodiment of an HVAC control system, in accordance with an aspect of the present disclosure.

FIG. 5 is a schematic view of an embodiment of a split HVAC system 120 that uses an eco-friendly refrigerant. The refrigerant being classified as numerically equal to or greater than the refrigerants A2L or B2L according to the ISO 817 refrigerant classification scheme. For example, the refrigerant may be an A2L, B2L, A2, B2, A3, or B3 refrigerant accordingly to the ISO 817 refrigerant classification scheme. Because the HVAC system 120 uses a refrigerant to cool an enclosed space 122, the HVAC system 120 includes an HVAC control system 124. The HVAC control system 124 blocks and/or reduces combustion of the refrigerant in the event the refrigerant leaks and/or is released. Examples of an enclosed space 122 include a home, apartment, office building.

The HVAC system 120 may be a split system with refrigerant conduits 54 that couple the indoor unit 56 to the outdoor unit 58. The refrigerant conduits 54 transfer the refrigerant between the indoor unit 56 and the outdoor unit 58, primarily transferring liquid refrigerant in one direction and vaporized refrigerant in an opposite direction.

A heat exchanger 60 in the outdoor unit 58 serves as a condenser for re-condensing vaporized refrigerant flowing from the indoor unit 56 to the outdoor unit 58 via one of the refrigerant conduits 54, while a heat exchanger 62 of the indoor unit 56 functions as an evaporator. During operation, the liquid refrigerant in the heat exchanger 62 absorbs energy causing it to evaporate. After passing through the heat exchanger 62, the evaporated refrigerant is redirected to the outdoor unit 58 where a fan 64 draws air over the heat exchanger 60 enabling the vaporized refrigerant to condense by rejecting heat to the atmosphere. The heat transfer cycle then begins again as the liquid refrigerant is pumped by the compressor 65 back to the heat exchanger 62 where it absorbs energy from air blown by the blower 66. After passing over the heat exchanger 62, the cool air is carried through one or more air ducts 68 to various areas of the enclosed space 122.

In some embodiments, the indoor unit 56 may include the furnace system 70. The furnace system 70 may include a burner assembly and heat exchanger, among other components. In some embodiments, the furnace system 70 combusts a fuel, such as natural gas, to generate heat. The combustion products may pass through tubes or piping in a heat exchanger, separate from heat exchanger 62, such that air directed by the blower 66 passing over the tubes or pipes absorbs heat from the combustion products. The heated air may then be routed from the furnace system 70 to the ductwork 68 for heating the enclosed space 122. In some embodiments, the furnace 70 may not combust a fuel, but may instead use electrical energy to heat air blown by the blower 66.

Unfortunately, HVAC systems may leak refrigerant. And while refrigerant leaks are not of particular concern, leaks in the HVAC system 120 using a refrigerant may be problematic if the refrigerant ignites. Accordingly, the HVAC system 120 includes an HVAC control system 124 that blocks and/or reduces combustion of the refrigerant. The HVAC control system 124 includes one or more sensors 126 capable of sensing the presence of the refrigerant. In response to sensing the refrigerant, the sensors 126 send a signal indicative of the refrigerant to a controller 128. The types of sensors 126 used to detect the refrigerant may include electrochemical, catalytic bead, photoionization, infrared point, infrared imaging, semiconductor, ultrasonic, holographic.

As illustrated, the sensors 126 may be in various locations. For example, the HVAC control system 124 may include sensors 126 in air ducts 68, in one or more rooms of the enclosed space 122, as well as sensors in the indoor unit 56. As illustrated, the indoor unit 56 includes a sensor 126 in a blower compartment 130, a furnace compartment 132, and in a heat exchanger compartment 134. The sensors 126 may therefore be in the same compartment as the heat exchanger 62 as well as upstream and/or downstream from the heat exchanger 62. However, the type, location, and number of sensors 126 may vary depending on the embodiment.

The controller 128 may include a processor 136 and a memory 138 used in processing one or more signals from one or more sensors 126. For example, the processor 136 may be a microprocessor that executes software to control the HVAC control system 124. The processor 136 may include multiple microprocessors, one or more "general-purpose" microprocessors, one or more special-purpose microprocessors, and/or one or more application specific integrated circuits (ASICS), or some combination thereof. For example, the processor 136 may include one or more reduced instruction set (RISC) processors.

The memory 138 may include a volatile memory, such as random access memory (RAM), and/or a nonvolatile memory, such as read-only memory (ROM). The memory 138 may store a variety of information and may be used for various purposes. For example, the memory 138 may store processor executable instructions, such as firmware or software, for the processor 136 to execute. The memory may include ROM, flash memory, a hard drive, or any other suitable optical, magnetic, or solid-state storage medium, or a combination thereof. The memory may store data, instructions and any other suitable data.

In operation, the controller 128 receives one or more signals indicative of the concentration of refrigerant from one or more sensors 126. In some embodiments, the controller 128 compares the detected concentration of refrigerant to a threshold concentration to determine whether the detected concentration of refrigerant is capable of combustion. If the concentration is incapable of combustion, the controller 128 may continue monitoring feedback from the sensors 126. However, if the concentration is capable of combustion, the controller 128 may control one or more power switches 140 and/or gas valves 142 to reduce and/or block combustion of the refrigerant from an energy source.

For example, the controller 128 may activate a switch 140 to turn off the blower 166. The controller 128 may also activate a switch 140 to turn off an electrically powered furnace 70. In some embodiments, the controller 128 may turn off electrical power to one or more locations, such as rooms, in the enclosed space 122 using one or more switches 140 in a breaker box 143. In this way, the controller 128 is able to turn off electrical devices such as power to outlets 144, lights, appliances, water heater, to block and/or reduce combustion of the refrigerant.

As illustrated, the indoor unit 56 may be positioned in a utility room, an attic, a basement. These locations typically include one or more water heaters 146 that may use gas, such as natural gas, to heat water. These water heaters 146 may use a pilot light 148 to ignite the gas. In order to block and/or reduce the possibility of an energy source combusting the refrigerant, the controller 128 may control a valve 142 that feeds gas to the water heater 146 and/or pilot light 148, thus eliminating such an energy source from combusting the refrigerant. In some embodiments, the controller 128 may also control valves 142 that feed gas to other devices in the enclosed space 122 remotely located from the indoor unit 56. These devices may include a gas oven/cooktop 150 as well as a fireplace. In some embodiments, the HVAC system 120 may include a gas furnace 70. In embodiments containing a gas furnace, the controller 128 may close a valve 142 that feeds gas, such as natural gas, to the furnace 70, which blocks and/or reduces the ability of an energy source, such as heat from the furnace 70, from combusting the refrigerant. In some embodiments, the controller 128 may close a valve 142, such as a main valve, that feeds gas to the entire structure. By controlling the flow of electricity and/or gas using one or more switches and valves 140, 142, the HVAC control system is able to reduce and/or block combustion of refrigerant that may have leaked out of the HVAC system 120.

In some embodiments, the controller 128 may communicate through wireless and/or wired networks with an electronic device 152. That is, the controller 128 may provide updates and/or receive input from a user through the electronic device 152. The electronic device 152 may be a cell phone, laptop, smart thermostat, tablet, watch. For example, the controller 128 may provide a warning to a user that refrigerant is leaking from the HVAC system 120. The warning may be provided in a variety ways including as a written message on a display of electronic device 152, an audio message, a warning sound, flashing lights, or combinations thereof.

In some embodiments, the controller 128 may request feedback from the user through the electronic device 152. The feedback may include confirming shutoff of electrical power and/or gas flow into one or more portions of the enclosed space 122 and/or enabling the user to designate which switches 140 and/or valves 142 should be activated. The electronic device 152 may also enable a user to change the threshold concentration of refrigerant used to determine whether combustion of the refrigerant is possible and/or likely.

Figure 6:
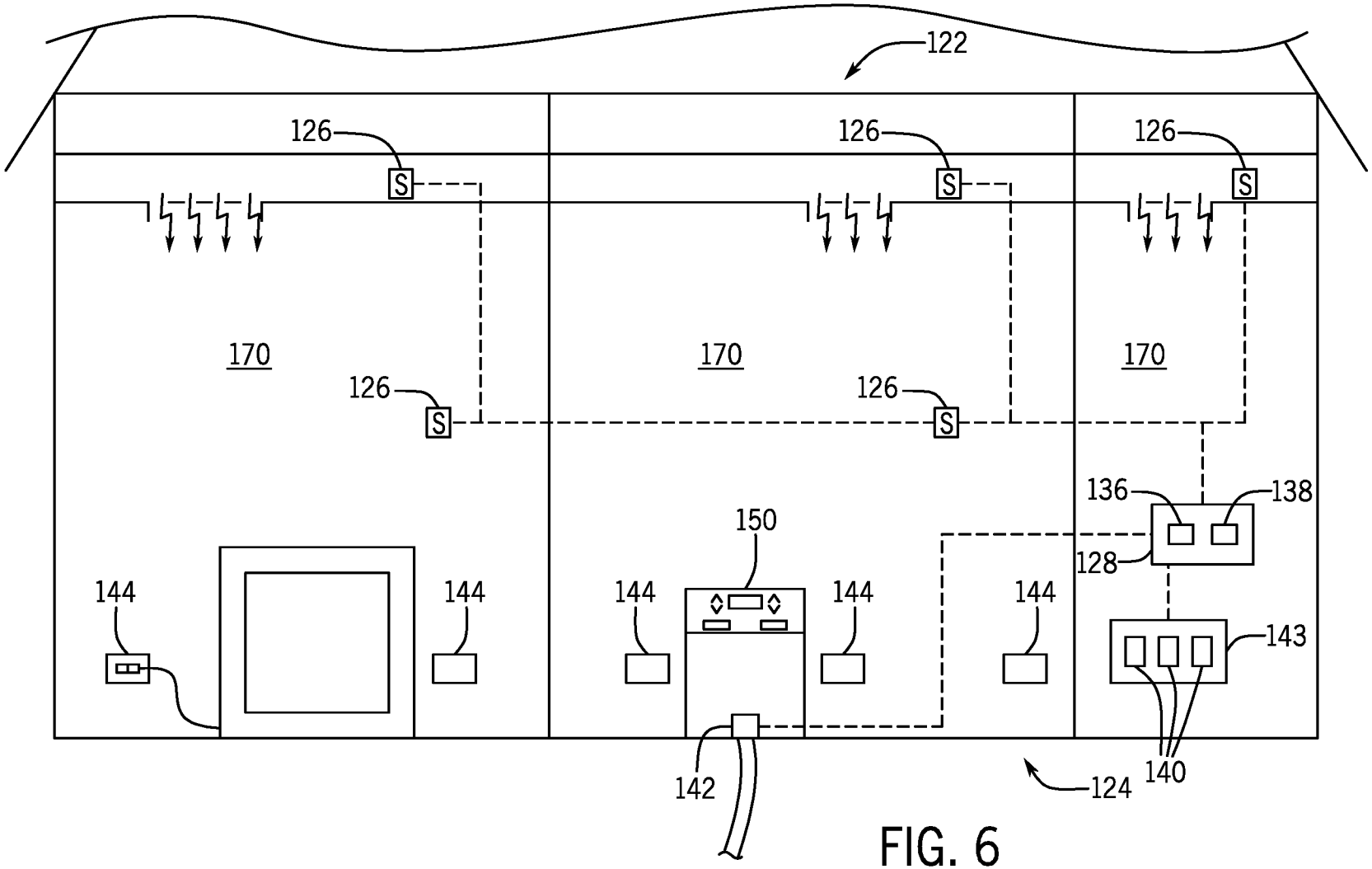
FIG. 6 is a schematic view of an embodiment of an HVAC control system, in accordance with an aspect of the present disclosure.

FIG. 6 is a schematic view of an embodiment of the HVAC control system 124. As explained above, the HVAC control system 124 controls one or more switches 140 and/or valves 142 to shut off the flow of electrical power and/or gas to the enclosed space 122 to block and/or reduce combustion of a refrigerant. As illustrated, the enclosed space 122 may include one or more rooms 170. Instead of shutting off power to the entire structure/building, the controller 128 may be programmed to shut down power and/or gas flow to a subset/portion of the enclosed space 122 in response to a detected leak of the refrigerant. In other words, the controller 128 may not shut off all power and gas flow to the enclosed space 122, but instead may shut off power and/or gas in one or more rooms 170 where the refrigerant is most likely to ignite. For example, a first room 170 may have a concentration of refrigerant capable of combustion while the concentration of the refrigerant in the remaining rooms 170 is unlikely to ignite or is incapable of combusting. Accordingly, the remaining rooms 170 may continue to receive electricity and/or gas.

Figure 7:
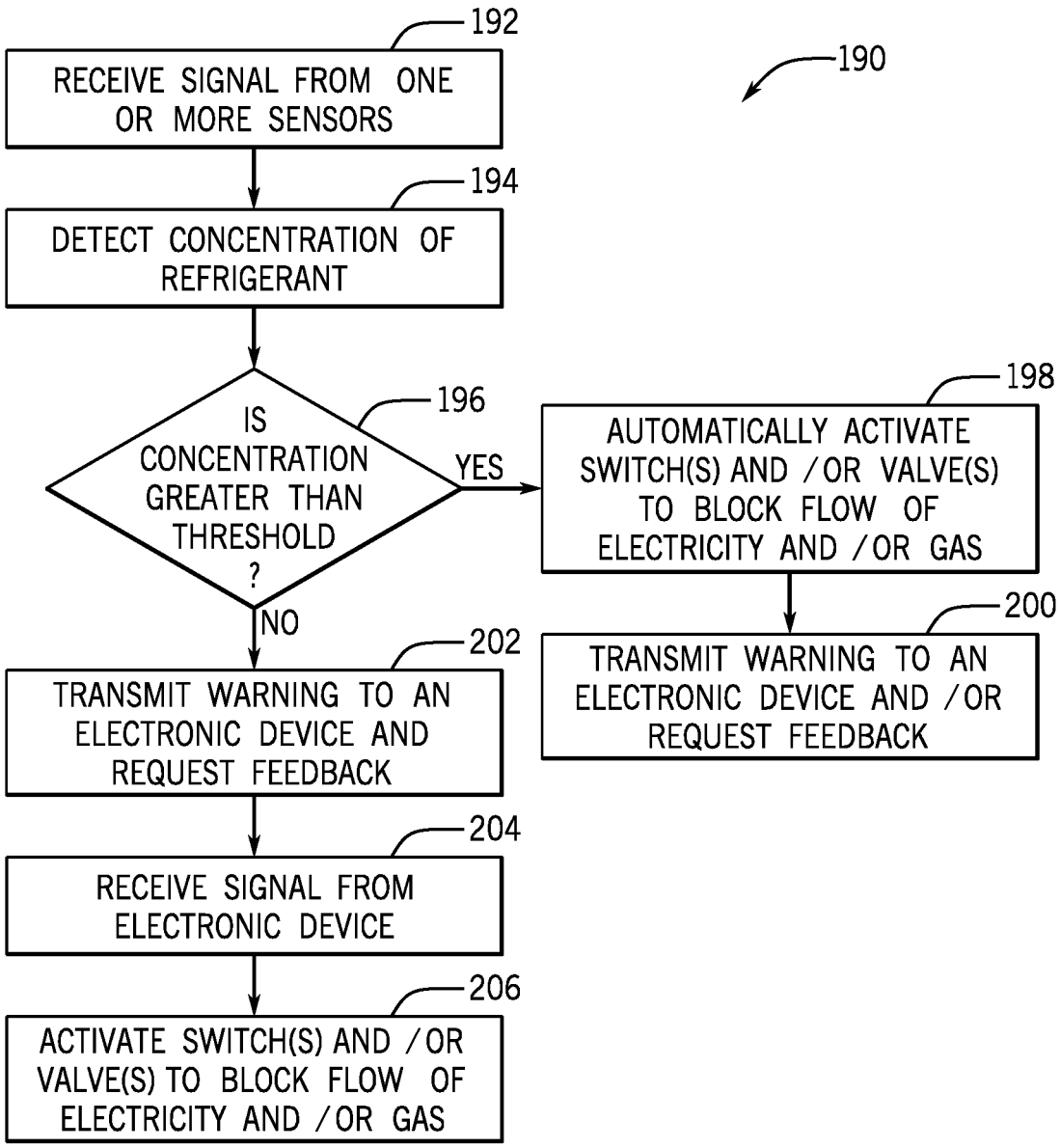
FIG. 7 illustrates a flow chart of a method for controlling an HVAC control system, in accordance with an aspect of the present disclosure.

FIG. 7 illustrates a flow chart 190 of a method for controlling an HVAC control system 124. The method begins as the controller 128 receives signals from one or more sensors 126, as indicated by step 192. The signals from the sensors 126 are indicative of a refrigerant, such as a concentration of the refrigerant. The controller 128 uses these signals from the sensors 126 to determine/detect the concentration of the refrigerant, as indicated by step 194. The controller 128 then determines if the concentration of the refrigerant is greater than a threshold, such as a concentration capable of combusting, as indicated by step 196. If the answer is yes, the controller 128 may activate one or more switches 140 and/or valves 142 to block the flow of electricity and/or gas to the enclosed space 122, as indicated by step 198. The controller 128 may then or simultaneously transmit a warning to the electronic device 152 and/or request feedback from a user through the electronic device 152, as indicated by step 200. As explained above, the requested feedback from the controller 128 may include confirmation of the controller's decision to shut off the flow of electricity and/or gas. The requested feedback may also include a request for the user to designate which switches 140 and/or valves 142 to activate.

If the concentration is less than the threshold, the controller 128 may still transmit a warning to an electronic device 152 advising a user that there is a leak of refrigerant in the enclosed space 122, as indicated by step 202. The controller 128 may also request feedback from the user regarding activation of one or more switches 140 and/or valves 142 as a control precaution even if the concentration is less than the threshold. The controller 128 receives feedback from the user through one or more signals transmitted from the electronic device 152, as indicated by step 204. The controller 128 may then activate one or more switches 140 and/or valves 142 to block the flow of electrical power and/or gas to block and/or reduce combustion of the refrigerant, as indicated by step 206. While the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Only certain features and embodiments of the disclosure have been illustrated and described, many modifications and changes may occur to those skilled in the art, such as variations in sizes, dimensions, structures, shapes and proportions of the various elements, or values of parameters, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed subject matter. It should be appreciated that in the development of any such actual implementation, as in any engineering or design project, numerous implementation specific decisions may be made. Such a development effort might be complex and time consuming, but would be a routine undertaking of design, fabrication, and manufacture for those of ordinary skill having the benefit of this disclosure, without undue experimentation.

The invention claimed is:

1. A heating, ventilation, and air conditioning (HVAC) control system, comprising:

a sensor configured to detect a refrigerant in an air-conditioned enclosed space released from an HVAC system and to emit a signal indicative of the detection;

a switch configured to block a flow of electricity to the air-conditioned enclosed space; and a controller configured to receive the signal from the sensor and activate the switch to block the flow of electricity in response to detection of the refrigerant.

2. The system of claim 1, wherein the controller is configured to activate the switch in response to a detected concentration of the refrigerant in excess of a threshold concentration.

3. The system of claim 1, wherein the switch blocks the flow of electricity to a compressor of the HVAC system to block or reduce release of the refrigerant from the HVAC system.

4. The system of claim 1, wherein the switch blocks the flow of electricity to a heating unit of the HVAC system.

5. The system of claim 1, wherein the switch blocks the flow of electricity to one or more electrical outlets in the air-conditioned enclosed space.

6. The system of claim 1, wherein the sensor comprises a chemical sensor, an optical sensor, or both.

7. The system of claim 1, wherein the sensor is coupled to an air duct downstream of an evaporator coil of the HVAC system relative to an airflow path through the HVAC system.

8. The system of claim 1, wherein the sensor is a coupled to an air duct upstream from an evaporator coil of the HVAC system relative to an airflow path through the HVAC system.

9. A heating, ventilation, and air conditioning (HVAC) control system, comprising:

a sensor configured to detect a refrigerant in an air-conditioned enclosed space released from an HVAC system and to emit a signal indicative of the detection;

a valve configured to block a flow of a combustible fluid, different from the refrigerant, to the air-conditioned enclosed space; and a controller configured to receive the signal from the sensor and activate the valve to block the flow of the combustible fluid in response to detection of the refrigerant.

10. The system of claim 9, wherein the controller is configured to activate the valve in response to a detected concentration of the refrigerant in excess of a threshold concentration.

11. The system of claim 9, wherein the valve blocks the combustible fluid from flowing to a water heater, wherein the combustible fluid comprises fuel gas.

12. The system of claim 9, wherein the valve blocks the combustible fluid from flowing to a heating unit of the HVAC system.

13. The system of claim 9, comprising a switch, wherein the controller is configured to receive the signal from the sensor, detect the refrigerant, and activate the switch to block a flow of electricity in response to the detection of the refrigerant.

14. The system of claim 9, wherein the sensor comprises a chemical sensor, an optical sensor, or both.

15. A heating ventilation and air conditioning (HVAC) control system, comprising:

a sensor configured to detect a presence of a refrigerant in an air conditioned enclosed space, wherein the refrigerant is numerically equal to or greater than A2L or B2L of ISO 817 refrigerant classification scheme, released from an HVAC system and to emit a signal indicative of the detection;

an electronic device; and a controller configured to receive the signal from the sensor and transmit a warning message to the electronic device, wherein, based on the signal, the controller is further configured activate a switch to block a flow of electricity to the air conditioned enclosed space, activate a valve to block a combustible gas flow, different from the refrigerant, to the air conditioned enclosed space, or both.

16. The system of claim 15, wherein the warning message comprises an audible tone, a written message, an audible message, a flashing light, or a combination thereof.

17. The system of claim 15, wherein the electronic device is configured to transmit a second signal to the controller to activate the switch to block the flow of electricity in response to the detection of the refrigerant.

18. The system of claim 15, wherein the electronic device is configured to transmit a second signal to the controller to activate the valve to block the combustible gas flow in response to the detection of the refrigerant.

19. The system of claim 15, wherein the electronic device is a mobile electronic device.

20. The system of claim 15, wherein the electronic device is a thermostat.

21. The system of claim 15, wherein the electronic device is a computer.

* * * * *